United States Patent [19]

Pan

[11] 4,086,872

[45] May 2, 1978

[54] ELECTROSTATIC COATING WITH POST CHARGER WEB OR COIL COATING AND POWDER FEED

[75] Inventor: Peter Naw Yank Pan, Country Club Hills, Ill.

[73] Assignee: The Continental Group, Inc., New York, N.Y.

[21] Appl. No.: 789,625

[22] Filed: Apr. 21, 1977

Related U.S. Application Data

[62] Division of Ser. No. 676,513, Apr. 13, 1976.

[51] Int. Cl.[2] ..... B05C 5/00; B05D 3/06; B05D 3/14

[52] U.S. Cl. ..... 118/630; 118/638; 118/654; 427/21; 427/22; 427/39

[58] Field of Search ..... 427/13, 16, 18, 20, 427/21, 25–30, 32, 33, 39–41, 43, 44; 346/153; 355/3 DD; 101/DIG. 13; 118/621–623, 627–630, 638, 624, 653–658

[56] References Cited

U.S. PATENT DOCUMENTS

| | | | |
|---|---|---|---|
| 2,221,338 | 11/1940 | Wintermute | 427/32 |
| 2,550,657 | 4/1951 | Ransburg | 427/33 |
| 3,248,253 | 4/1966 | Barford et al. | 118/630 X |
| 4,033,292 | 7/1977 | Klingenberg | 427/21 X |

*Primary Examiner*—Morris Kaplan

*Attorney, Agent, or Firm*—Diller, Brown, Ramik & Wight

[57] ABSTRACT

A system and process for electrodynamic powder coating of conducting and non-conducting substrates using an electrodynamic fluidized bed. The system generally includes a coating applicator means for applying charged particles to the substrate to be coated, and postcharging means for applying to the substrate an additional charge of such polarity as to cause an increase in the electrostatic forces holding the coating particles to the substrate. The system further includes a precharging means for precharging the substrate with a charge of such polarity as to effect more uniform coating of the substrate and a higher rate of coating. Where the substrate to be coated is a continuous web, the system includes a conveying means for conveying the web through the various positions adjacent to the three aforementioned means. The coating applicator means may be an electrodynamic coating apparatus of the electrodynamic fluidized bed type and comprising a fluidized bed means and a charging bed means with a porous wall positioned therebetween, and a recharging means.

13 Claims, 4 Drawing Figures

ELECTROSTATIC COATING WITH POST CHARGER WEB OR COIL COATING AND POWDER FEED

This is a division of application Ser. No. 676,513, filed Apr. 13, 1976.

The invention generally relates to an electrodynamic coating system for coating conducting and non-conducting substrates using an electrodynamic fluidized bed.

In conventional electrostatic coating systems, the powdered material to be used in coating a substrate or substrates is generally fluidized by air so as to form a powder cloud which is then charged by a high voltage source (typically known as a "corona source"). However, such conventional systems are burdened with several disadvantages. In particular, it would be desirable to achieve more efficient and complete coating of all substrates, and in particular substrates of the non-conductive type. In addition, in such systems, it would be desirable to achieve better control of the charged powder cloud, which improved control would have two results: quality control of the deposition rate and amount of coating material applied to the substrates; and ability to achieve precision-controlled weighted coating of selected areas of the substrate. Furthermore, it would be desirable to achieve increased electrostatic holding forces (forces holding the newly applied powder particles to the substrates) which would preclude the inadvertent loss of newly applied powder particles during that time just subsequent to coating and prior to fusing or curing. This would allow continuous coating at high coating rates of a web-like substrate moving along a predetermined path in assembly line-like manner. Finally, in such an assembly line-type operation, it would be desirable to achieve certain other objectives, namely, more uniform coating, higher rates of coating, elimination of loss of particles from newly coated substrates by the phenomena of "image force attraction," higher feed rates in the feeding of unfluidized powder particles to the fluidized bed, and avoidance of any disturbing effect on the charging and coating operations due to the achievement of the latter-mentioned goal.

It is known that more efficient and complete substrate coating, better cloud control, and increased electrostatic holding forces are directly proportional to the charge per unit mass (or Q/M ratio) of the charged powder cloud. This fact places conventional electrostatic fluidized bed systems at a distinct disadvantage since it is known that the Q/M ratio of the powder particles in such systems is lower than the Q/M ratio of powder particles in a conventional electrostatic spray gun operation by a factor of 2–3 times. Thus, achievement of the three last-mentioned goals will result if higher, and preferably 2–3 times higher, Q/M ratios can be achieved in electrostatic fluidized bed systems.

In the latter regard, the inventor has realized the fact that the Q/M ratio is directly proportional to the electric field intensity within the fluidized bed system and to the residence time of fluidized powder particles within the area of influence of such electric field. In addition, the inventor has realized that the Q/M ratio is inversely proportional to the particle size of the powder and to the aerated bulk density of "virgin powder" supplied to the system. With respect to the latter, it has been realized that the powder/air ratio of the powder cloud should be as low as possible relative to the bulk density of unfluidized powder provided to the system. Thus, under conventional systems, powder/air ratios of only 2–3 times lower than the bulk density of unfluidized powder have been achieved. In contrast, under the system according to the present invention, the powder/air ratio has been lowered to such a value as to be 6–10 times lower than the bulk density of unfluidized powder provided to the system. This has resulted in the achievement, by the electrodynamic fluidized bed system according to the present invention, of a Q/M ratio 2–3 times higher than the corresponding ratio achieved by conventional electrostatic fluidized bed systems.

Therefore, it is an object of the present invention to achieve more efficient and complete coating of substrates of both the conducting and non-conducting type by means of an electrodynamic fluidized bed applicator.

It is a further object of the present invention to achieve increased Q/M ratios, and thus to increase electrostatic holding forces binding newly coated charged particles to the substrates.

It is a further object of the present invention to provide assembly line-type coating of a continuous web moving along a predetermined path.

It is a further object of the present invention to eliminate image force attraction of charged particles away from the moving web.

It is a further object of the present invention to achieve more uniform coating of substrates at higher rates of coating.

It is an additional object of the present invention to achieve higher feed rates in feeding "virgin powder" to the system while at the same time not disturbing the charging and coating operations taking place therein.

It is an additional object of the present invention to obtain better cloud control, and thus to increase the residence time during which the charged powder cloud remains within the area of influence of the applied electric field.

Finally, it is an additional object of the present invention to achieve more efficient and precision-controlled weighted coating of the selected areas of the substrate.

With the above and other objects in view that will hereinafter appear, the nature of the invention will be more clearly understood by reference to the following detailed description, the appended claimed subject matter, and the accompanying drawings, of which:

Figure 1:
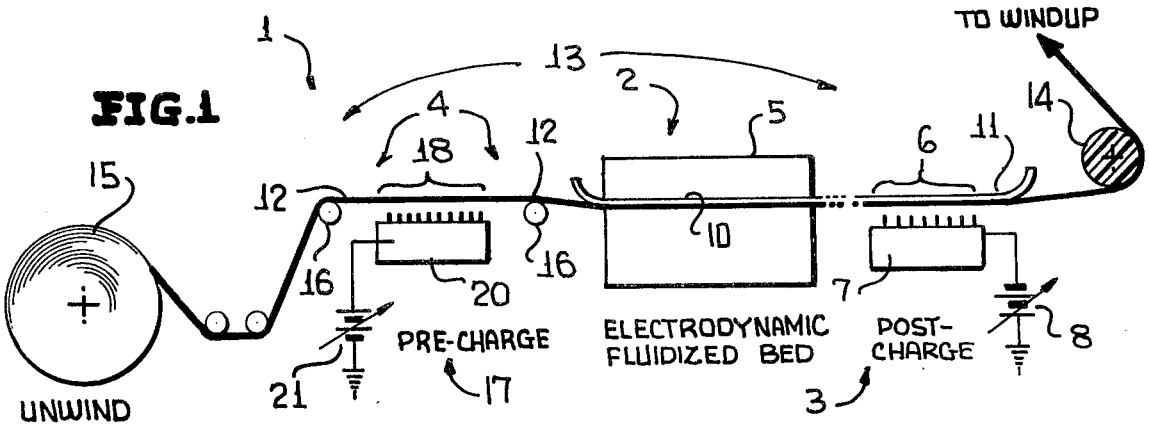
FIG. 1 is a diagrammatic representation of an electrodynamic coating system according to the present invention.

The invention will now be described in detail with respect to FIG. 1 of the drawings. The electrodynamic coating system 1, in its broadest terms, comprises at least a coating applicator means 2 and a postcharging means 3 for respectively coating and postcharging a substrate 4. The coating means 2 may be an electrodynamic fluidized bed 5, the details of which will be hereinafter described. The postcharging means 3 may include a plurality of corona pins 6 mounted on a support 7, the pins 6 being connected to a variable high voltage DC source 8. The bed 5 may be further provided with a plate or groundplane electrode 10 disposed on that side of the substrate 4 opposite to the side on which the powder particles (not shown) are resident. The groundplane electrode 10 thus serves as a ground reference during the coating process. Furthermore, the groundplane electrode 10 may be extended so as to form an extension 11 opposite the corona pins 6 with the substrate 4 disposed therebetween, thus providing a ground reference for use in the postcharging process. Whereas one embodiment of the postcharging means 3 has thus far been described as including corona pins 6, it is to be understood that other possibilities exist. For example, the corona pins 6 may be replaced by at least one charging wire (not shown) connected to the source 8 so as to be energized thereby and thus to achieve the same postcharging effect. In addition, the ground-plane electrode 10 and/or the extension 11 may be a plurality of corona pins (not shown) similar to the pins 6 and support 7 which make up the postcharging means 3. Alternatively, the groundplane electrode 10 and/or the extension 11 may be at least one charging wire (not shown).

It is to be noted that the substrate 4 may be any type of substrate, conductive or non-conductive, and either self-contained or continuous in nature. In the specific embodiment of FIG. 1, the substrate 4 is a continuous web 12 conveyed through the system by a conveying means generally indicated by the reference numeral 13. Specifically, the conveying means 13 includes a wind-up roller 14, an unwind roller 15 and several intermediate rollers 16. The intermediate rollers 16 may be of the non-conductive type so as to eliminate the "image force attraction" phenomena from attracting charged particles from the continuous web 12 during the operation of the system 1.

The system 1 further includes a precharging means 17 which, in a manner similar to the postcharging means 3, includes a plurality of corona pins 18 mounted on a support 20 and the pins 18 being connected to a variable high voltage DC source 21. It is to be stressed that, whereas only one embodiment of the precharging means 17 has been described, other possibilities exist. For example, the precharging means 17 may be formed by the replacement of the corona pins 18 by at least one charging wire (not shown) connected to the source 21. In addition, where the continuous web 12 is of the non-conductive type, the precharging means 17 may be a steam applicator menas (not shown) for applying steam to the continuous web 12 passing adjacent thereto, thus causing the web 12 to appear to be conductive in nature, and thus achieving the same desired results as are achieved by the precharging means 17 in its previously described embodiments.

The operation of the system 1 may be described as follows. The continuous web 12, which may be conductive or non-conductive in nature, is unwound from the unwind roller 15 by the action of the wind-up roller 14. The web 12 passes over the rollers 16 (which, as previously described, may be of the non-conductive type) and passes adjacent to the precharging means 17.

The precharging means 17, which is made up of the variable high voltage DC source 21 connected to the corona pins 18, applies a high voltage electric field to the web 12 and surrounding air, causing ionization of the air to take place. The ions thus formed adhere to the web 12, causing the latter to become charged with a given polarity, for example, positively charged. The positively charged web 12 continues over the rollers 16 so as to arrive at the applicator means 2.

The applicator means 2 is made up of the electrodynamic fluidized bed 5 which functions in a manner which will be subsequently described to introduce charged powder particles in the vicinity of the charged web 12. Specifically, the powder particles thus presented will be charged with a polarity opposite to that of the polarity of the charged web 12. That is to say, the particles will be charged with a negative polarity. In addition, as previously described, the coating means 2 includes a groundplane electrode 10 which serves as a ground reference and is disposed on that side of the web 12 opposite to the side on which are contained the negatively charged particles (not shown). As a result, the negatively charged particles provided by the bed 5 will be attracted to the positively charged web 12 and to the ground reference or groundplane electrode 10 so as to impinge against the web 12 and adhere to it. The newly coated web 12 will then continue on its path to arrive at the postcharging means 3.

As previously described, the postcharging means 3 includes the corona pins 6 connected to the variable high voltage DC source 8 so as to be energized thereby. In addition, the postcharging means 3 may include an extension 11 of the groundplane electrode 10, which extension 11 serves as a ground reference. The source 8 is so connected to the corona pins 6 as to cause a high voltage electric field to be imposed in the vicinity of the coated web 12, the web 12 containing the newly applied negatively charged powder particles. The high voltage electric field is such as to produce ionization in the vicinity of the newly coated web 12, the ionization being of polarity opposite to the polarity of the ionization created by the precharging means 17, and the same as the polarity created by the bed 5 of the coating means 2, that is to say, the post-charging means 3 produces negative ionization in the vicinity of the coated web 12. As a result, the newly attached negatively charged particles on the surface of the newly coated web 12 undergo an electrostatic force which repells them from the surrounding vicinity of the web 12 and which, in effect, holds them to the web 12. In addition, those negatively charged ions which are closest to the newly coated surface of the web 12 will in many cases adhere to the web 12, thus causing the newly applied charged powder particles to become even more negatively charged. The resultant increase in the Q/M ratio (previously mentioned above) will also increase the effective electrostatic holding forces which bind the particles to the newly coated web 12.

With respect to the precharging function previously described, it is to be noted that the precharging process is especially useful when the substrate 4 or continuous web 12 is of the non-conductive type. Specifically, the precharging means 17 causes the web 12 to appear to be conductive in nature since, to the negatively charged particles in the bed 5, the web 12 appears to be positively charged. As a result, higher deposition rates and more uniform coating are achievable by the coating means 2, even when the web 12 is actually made up of non-conductive material. Additionally, the precharging of the web 12 serves to increase the electrostatic holding force which binds the negative particles provided by the bed 5 to the web 12 after the completion of the coating process. Finally, as previously mentioned, the same results can be achieved by employing the steam applicator means (not shown) as the precharging means 17, the steam applied by the steam applicator means serving to make the web 12 appear to be conductive to the negatively charged particles provided by the bed 5.

Figure 2:
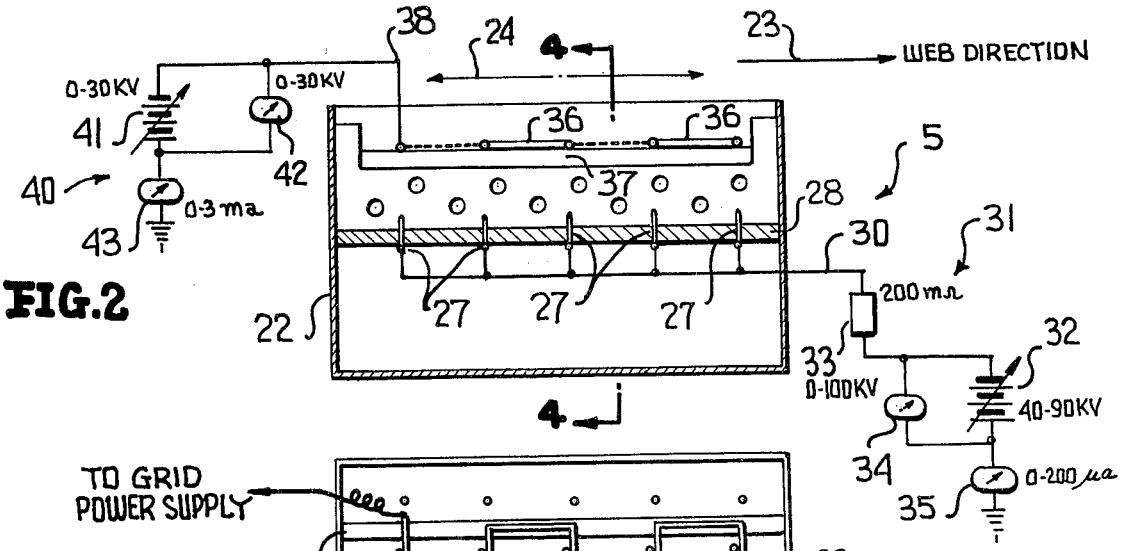
FIG. 2 is a cross-sectional side view of a coating apparatus for use with the system according to the present invention.

The electrodynamic fluidized bed 5 will now be described in more detail with reference to FIGS. 2, 3 and 4. With reference to FIG. 2, the bed 5 is made up of a coating chamber 22 of which a substrate (not shown) moving in a direction indicated by the arrow 23 is drawn into a coating position indicated by the double headed arrow 24. Referring to FIG. 4, the chamber 22 generally contains a fluidizing reservoir 25 and a charging bed 26. Thus, the substrate (not shown) to be coated is drawn into position for coating over that portion of the chamber 22 designated as the charging bed 26.

Referring back to FIG. 2, the charging bed 26 includes a plurality of corona pins 27 mounted in a distributor plate 28. The corona pins 27 are connected via the lead 30 to a corona power supply, generally indicated as 31. In the arrangement shown, the corona power supply 31 comprises the series combination of a variable high voltage DC source 32 and the resistor 33, as well as associated voltmeter 34 and ammeter 35, if desired.

The bed 26 further includes a control grid 36 mounted on supporting bars 37, and connected via lead 38 to the grid power supply generally indicated as 40. In the embodiment shown, the grid power supply 40 includes the variable high voltage DC source 41 as well as associated voltmeter 42 and ammeter 43.

Figure 3:
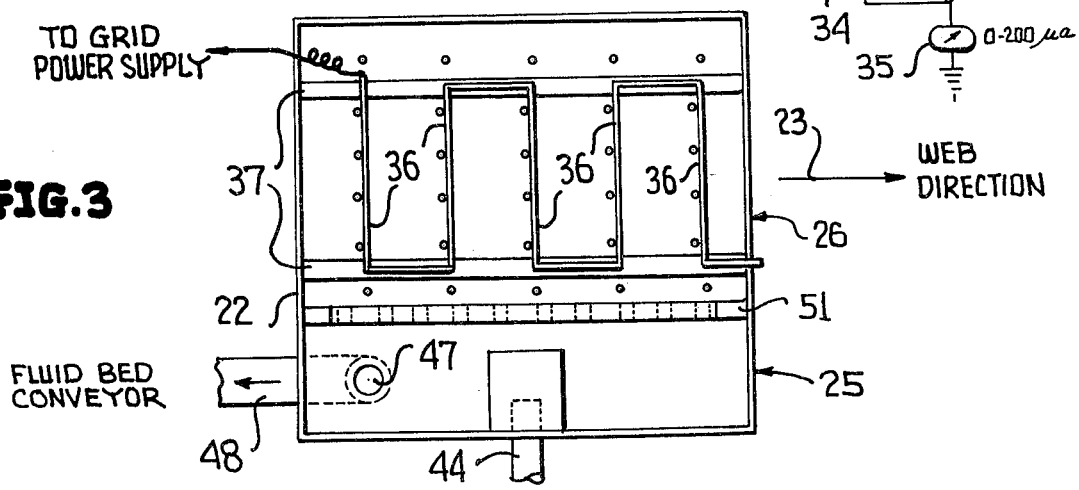
FIG. 3 is a top view of a coating apparatus for use with the system according to the present invention.
Figure 4:
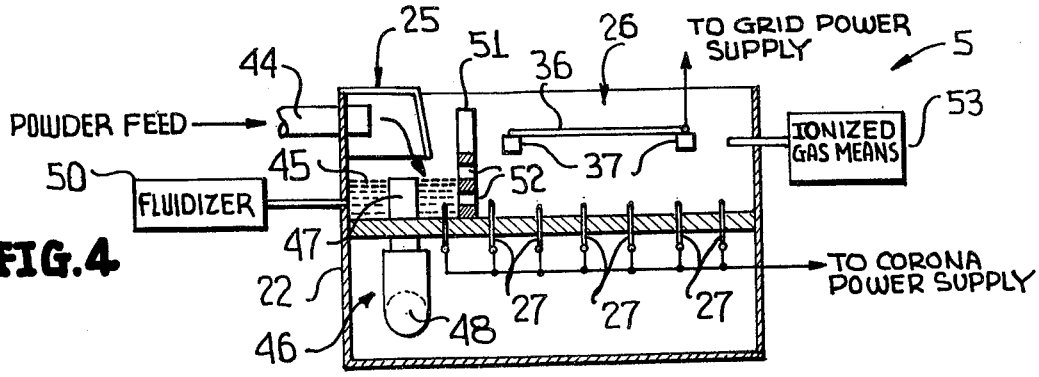
FIG. 4 is a cross-sectional view along the section line 4—4 of FIG. 2.

Referring to FIG. 3, it is to be noted that the control grid 36 mounted on the support bars 37 may be of any geometrical design or shape so as to be useful in weighted or shaped coating of substrates.

Referring to FIGS. 3 and 4, the fluidizing reservoir 25 within the chamber 22 is arranged to receive "virgin powder" from a powder feed (not shown) via the duct 44. The powder can be fed to the fluidizing reservoir 25 using an air blower system, an auger feeder, or any other conventional feed mechanism. Control of the powder level 45 within the reservoir 25 is achieved by the provision of a drain-type level controller 46 comprising the drainpipe 47 and the return duct 48. Thus, the reservoir 25 can be continuously fed with "virgin powder" and a constant level of powder 45 can be maintained by returning overflow powder to the feeder (not shown) through the drainpipe 47 and the duct 48, it being possible by conventional methods to connect the duct 48 to a fluidized bed conveyor (not shown).

In addition, the powder 45 contained within the reservoir 25 is fluidized by conventional methods. For example, the previously mentioned air blower system (not shown) which can be connected to the powder feed duct 44 in order to achieve an air blower feeder system can serve the additional purpose of providing a forced ar fluidizing system. Alternatively, a conventional fluidizer 50 (for example, of the vibratory type) can be connected and/or associated with the reservoir 25 so as to achieve fluidization of the powder 45 contained therein.

Finally, a porous wall 51 containing holes 52 is provided between the fluidizing reservoir 25 and the bed 26. The porous wall 51 serves the initial function of providing for measured and uniform introduction of powder into the bed 26. The wall 51 serves the additional function of separating the reservoir 25 from the bed 26 so as to proclude interference between the activities respectively conducted therein. Specifically, where a high rate of coating is desirable, a high feed rate through the duct 44 is necessary. However, in conventional arrangements, the achievement of such high feed rates is limited by the necessity for non-disturbance of the powder cloud charging activity conducted within the bed 26 by the high rate of feed activity within the reservoir 25. Thus, accordng to the invention, the wall 51 serves to preclude such an interference while, at the same time, providing for the measured transfer of powder from the reservoir 25 to the bed 26 via the holes 52 contained within the wall 51.

The detailed operation of the electrodynamic fluidized bed 5 will now be described with initial reference to FIG. 4. The "virgin powder" is fed by means (not shown, but previously discussed above) into the reservoir 25. A fluidized bed of powder 45 is formed in the reservoir 25 by the action of the fluidizer 50 (or other conventional fluidizing methods, as previously discussed above). Control of the level of the fluidized bed of powder 45 is maintained via the level controller 46 as previously discussed. Since the fluidized bed of powder 45 is endowed with fluid-like characteristics, it tends to flow (like a liquid) through the holes 52 in the wall 51 so as to be introduced in measured amounts into the bed 26.

Referring now to FIGS. 2 and 4, the powder now contained in the bed 26 is electrostatically charged by the application of a high voltage electric field by the corona power supply 31 acting through the corona pins 27. Specifically, the corona power supply 31 applies a high voltage electric field to the powder-air combination contained within the bed 26 so as to cause ionization to take place. The ions thus created attach themselves to powder particles with the resultant creation of a charged powder cloud. Whereas the powder cloud may be charged with any given polarity, it will be assumed for purposes of discussion that the powder cloud is charged negatively.

Once charged, the powder cloud rises within the bed 26 toward the control grid 36 and thus toward the substrate (not shown) due to electrostatic attraction force between the cloud and the substrate (not shown). As previously mentioned, the charging process as thus far described results in a powder cloud having a powder-air ratio 2–3 times lower than the bulk density of the unfluidized powder provided to the reservoir 25. In addition, the charging process as thus far described results in a Q/M ratio which is insufficient in magnitude so far as the purposes of better cloud control, more complete and efficient coating of substrates, and increased electrostatic holding forces are concerned.

Thus, according to the invention, recharging of the powder cloud as it rises within the bed 26 and toward the substrate (not shown) is provided. Specifically, with reference to FIGS. 2, 3 and 4, the control grid 36 is energized by the grid power supply 40 which applies high voltage thereto, thus achieving the further charging or "recharging" of the powder cloud. Furthermore, as best shown in FIG. 3, the grid 36 may be geometrically shaped or designed so as to provide for selective charging of the powder cloud in selected areas only, the latter being useful in achieving weighted or selective coating of substrates.

In addition, it is to be noted that the same "recharging" effect can be accomplished by introducing ionized gas into the bed 26, and specifically, in the vicinity where the powder-to-air ratio is low. Such ionized gas, for example, can be introduced by conventional "ionized gas means" 53, as shown in FIG. 4.

As a result of the recharging process thus described, the powder cloud undergoes a further lowering of the powder-air ratio so that the latter achieves a value 6–10 times lower than the bulk density of the unfluidized powder provided to the reservoir 25. In addition, the recharging process results in the achievement of a Q/M ratio having a value 2–3 times higher than those achievable by conventional systems. Thus, as a result of the invention, the following results are achieved: first, better cloud control with a resultant ability to achieve both quality control of deposition rates and amounts of coating material applied, as well as achievement of efficient weighted coating of selected areas of substrates; second, more efficient and complete coating of the substrates, and especially of non-conductive substrates; and third, increased electrostatic holding forces holding the powder coating to the newly coated substrates.

With respect to the achievement of better cloud control, it is to be noted that manipulation of the corona power supply 31 and the grid power supply 40, and specifically manipulation of the polarities and intensity levels therein involved, will lead to varying degrees of cloud control. Thus, under the present invention, it is possible to trap or suspend a charged powder cloud between the plate 28 and the grid 36. In this regard proper geometrical design of the grid 36 will intensify cloud formation at desired locations within the bed 26 and thus, through electric field shaping, make possible programmed variation of the coating weight on objects to be coated. Furthermore, employing the corona power supply 31 and/or the grid power supply 40 to produce pulsed voltages of appropriate pulse width, intensity, phase, polarity and frequency has the effect of selective cloud control, which will in turn lead to the achievemet of pattern coating, intermittent coating, etc.

While a preferred form and arrangement has been shown in illustrating the invention, it is to be clearly understood that various changes in details and arrangements may be made without departing from the spirit and scope of this disclosure.

I claim:

1. An electrodynamic coating system for coating a substrate, comprising in combination:

coating applicator means disposed adjacent to said substrate for applying thereto charged particles of a given polarity so as to produce electrostatic forces attracting and holding said charged particles to said substrate; and postcharging means disposed downstream of said applicator and adjacent to said substrate for applying thereto a charge of said given polarity whereby to effect an increase in the electrostatic forces holding said applied particles to said substrate.

2. A system as recited in claim 1 wherein said postcharging means comprises a plurality of corona pins and a high voltage source connected thereto.

3. A system as recited in claim 1 wherein said postcharging means comprises at least one charging wire and a high voltage source connected thereto.

4. A system as recited in claim 1 wherein said postcharging means includes a groundplane electrode and a plurality of corona pins disposed, respectively, on opposite sides of said substrate.

5. A system as recited in claim 4 wherein said groundplane electrode comprises a pluraity of corona pins.

6. A system as recited in claim 4 wherein said groundplane electrode comprises at least one charging wire.

7. A system as recited in claim 1 wherein said substrate is a continuous web and including conveying means for conveying said web successively to positions adjacent to said coating applicator means and to said postcharging means, respectively.

8. A system as recited in claim 7 wherein said conveying means includes non-conductive rollers whereby to eliminate image force attraction of said charged particles from said web.

9. A system as recited in claim 1 including precharging means disposed adjacent to said substrate for precharging said substrate with a charge of polarity opposite to said given polarity whereby to obtain more uniform coating of said substrate and a higher rate of coating.

10. A system as recited in claim 9 wherein said precharging means comprises a plurality of corona pins and a high voltage source connected thereto.

11. A system as recited in claim 9 wherein said precharging means comprises at least one charging wire and a high voltage source connected thereto.

12. A system as recited in claim 9 wherein said precharging means comprises steam applicator means for applying steam to said substrate so as to cause said substrate to appear to be conductive in nature.

13. A system as recited in claim 9 wherein said substrate to be coated is a continuous web, and including conveying means for successively conveying said web to positions adjacent to said precharging means, to said coating applicator means, and to said postcharging means, respectively.

* * * * *